US009211740B2

(12) United States Patent
Ishikawa et al.

(10) Patent No.: US 9,211,740 B2
(45) Date of Patent: Dec. 15, 2015

(54) PRINTER APPARATUS AND PRINTER APPARATUS CONTROL METHOD

(71) Applicant: FUJITSU COMPONENT LIMITED, Tokyo (JP)

(72) Inventors: Tetsuhiro Ishikawa, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/165,722

(22) Filed: Jan. 28, 2014

(65) Prior Publication Data

US 2014/0219699 A1 Aug. 7, 2014

(30) Foreign Application Priority Data

Feb. 4, 2013 (JP) ..... 2013-019845

(51) Int. Cl.

| | |
|---|---|
| ***B41J 15/00*** | (2006.01) |
| ***B41J 15/16*** | (2006.01) |
| ***B41J 11/48*** | (2006.01) |
| ***B41J 15/18*** | (2006.01) |
| ***G07B 1/00*** | (2006.01) |
| ***B65H 20/02*** | (2006.01) |

(52) U.S. Cl.

CPC ..... *B41J 15/16* (2013.01); *B41J 11/485* (2013.01); *B41J 15/18* (2013.01); *B65H 20/02* (2013.01); *G07B 1/00* (2013.01); *B65H 2301/4139* (2013.01); *B65H 2404/143* (2013.01); *B65H 2404/144* (2013.01); *B65H 2404/1421* (2013.01)

(58) Field of Classification Search

CPC ..... B41J 15/16; B41J 15/18; B65H 20/02; B65H 2301/4139; B65H 2404/1421; B65H 2404/143; B65H 2404/144; B65H 23/002; B65H 23/0258; B65H 59/36; G03G 2215/00455

USPC ..... 400/618, 611; 271/9.01; 399/383, 391, 399/384; 226/109, 110

See application file for complete search history.

(56) References Cited

U.S. PATENT DOCUMENTS

| | | | | |
|---|---|---|---|---|
| 5,037,016 | A | 8/1991 | Wingerter | |
| 6,814,515 | B2 | 11/2004 | Tsuchiya et al. | |
| 7,857,534 | B2 | 12/2010 | Watanabe et al. | |
| 2009/0261140 | A1 * | 10/2009 | Kase et al. | 226/50 |

FOREIGN PATENT DOCUMENTS

| | | |
|---|---|---|
| EP | 0362976 | 4/1990 |
| JP | 2003-019845 | 1/2003 |
| JP | 2007-130842 | 5/2007 |

* cited by examiner

*Primary Examiner* — Matthew G Marini
(74) *Attorney, Agent, or Firm* — IPUSA, PLLC

(57) ABSTRACT

A printer apparatus includes a printing part including a platen roller and a print head for printing objects onto a recording sheet, and a feeding part for feeding the recording sheet to the printing part. The feeding part includes a first feed port and a second feed port for feeding the recording sheet, a first roller for conveying a first recording sheet fed through the first feed port, a second roller for conveying a second recording sheet fed through the second feed port, a delivery port for feeding the recording sheet conveyed by the first roller and the second roller, a tension member having elasticity, a third roller rotatably connected to the tension member and being pressed toward the first roller by the tension member, and a fourth roller rotatably connected to the tension member and being pressed toward the second roller by the tension member.

8 Claims, 14 Drawing Sheets

PRINTER APPARATUS AND PRINTER APPARATUS CONTROL METHOD

CROSS-REFERENCE TO RELATED APPLICATIONS

This patent application is based upon and claims the benefit of priority of Japanese Patent Application No. 2013-019845 filed on Feb. 4, 2013 the entire contents of which are incorporated herein by reference.

BACKGROUND OF THE INVENTION

1. Field of the Invention

The present invention relates to a printer apparatus and a printer apparatus control method.

2. Description of the Related Art

Printers for issuing receipts are widely used in various applications including cash registers, Automated Teller Machines (ATM), and Cash Dispensers (CD), for example. Such printers are configured to issue a receipt by conveying a recording sheet such as thermal recording paper that is wound into a roll, printing objects such as characters on the recording sheet using a print head, and conveying the recording sheet up to a predetermined length so that the recording sheet may be cut at the predetermined length by a cutter (See, e.g., Japanese Laid-Open Patent Publication No. 2003-19845, and Japanese Laid-Open Patent Publication No. 2007-130842).

There is a demand for a printer apparatus that is capable of printing on different sets of recording paper so that a printer apparatus may not have to be provided for each set of recording paper.

However, when measures are implemented to enable a printer apparatus to print on multiple sets of recording paper, the printer apparatus may be enlarged or the structure of the printer apparatus may be complicated. In turn, the price of the printer apparatus may increase and the printer apparatus may be prone to failure and defects, for example. Accordingly, a printer apparatus that is capable of printing on different sets of recording paper while having a compact and simple structure is desired.

SUMMARY

According to one embodiment of the present invention, a printer apparatus is provided that includes a printing part including a platen roller and a print head for printing objects onto a recording sheet, and a feeding part configured to feed the recording sheet to the printing part. The feeding part includes a first feed port and a second feed port for feeding the recording sheet, a first roller for conveying a first recording sheet fed through the first feed port, a second roller for conveying a second recording sheet fed through the second feed port, a delivery port for feeding the first recording sheet conveyed by the first roller and the second recording sheet conveyed by the second roller, a tension member having elasticity, a third roller rotatably connected to the tension member and being pressed toward the first roller by the elasticity of the tension member, and a fourth roller rotatably connected to the tension member and being pressed toward the second roller by the elasticity of the tension member.

According to another embodiment of the present invention, a control method is provided for controlling a printer apparatus including a printing part that includes a print head and a platen roller driven by a printing part motor, and a feeding part for feeding a recording sheet to the printing part, the feeding part including a plurality of feed ports for feeding different recording sheets, a first roller for conveying a first recording sheet fed through a first feed port, a second roller for conveying a second recording sheet fed through a second feed port, a tension member having elasticity, a third roller rotatably connected to the tension member, and a fourth roller rotatably connected to the tension member. The control method includes, when switching the recording sheet subject to printing at the printing part from the first recording sheet to the second recording sheet, stopping rotation of the printing part motor while the first recording sheet is held between the print head and the platen roller, rotating the second roller and conveying the second recording sheet toward the printing part while the first recording sheet is held between the print head and the platen roller, and rotating the printing part motor and releasing the first recording sheet from the print head and the platen roller when the second recording sheet is conveyed to a predetermined position.

According to an aspect of the present invention, a printer apparatus capable of printing on different recording sheets and having a compact and simple structure may be provided.

DESCRIPTION OF EMBODIMENTS

Figure 1:
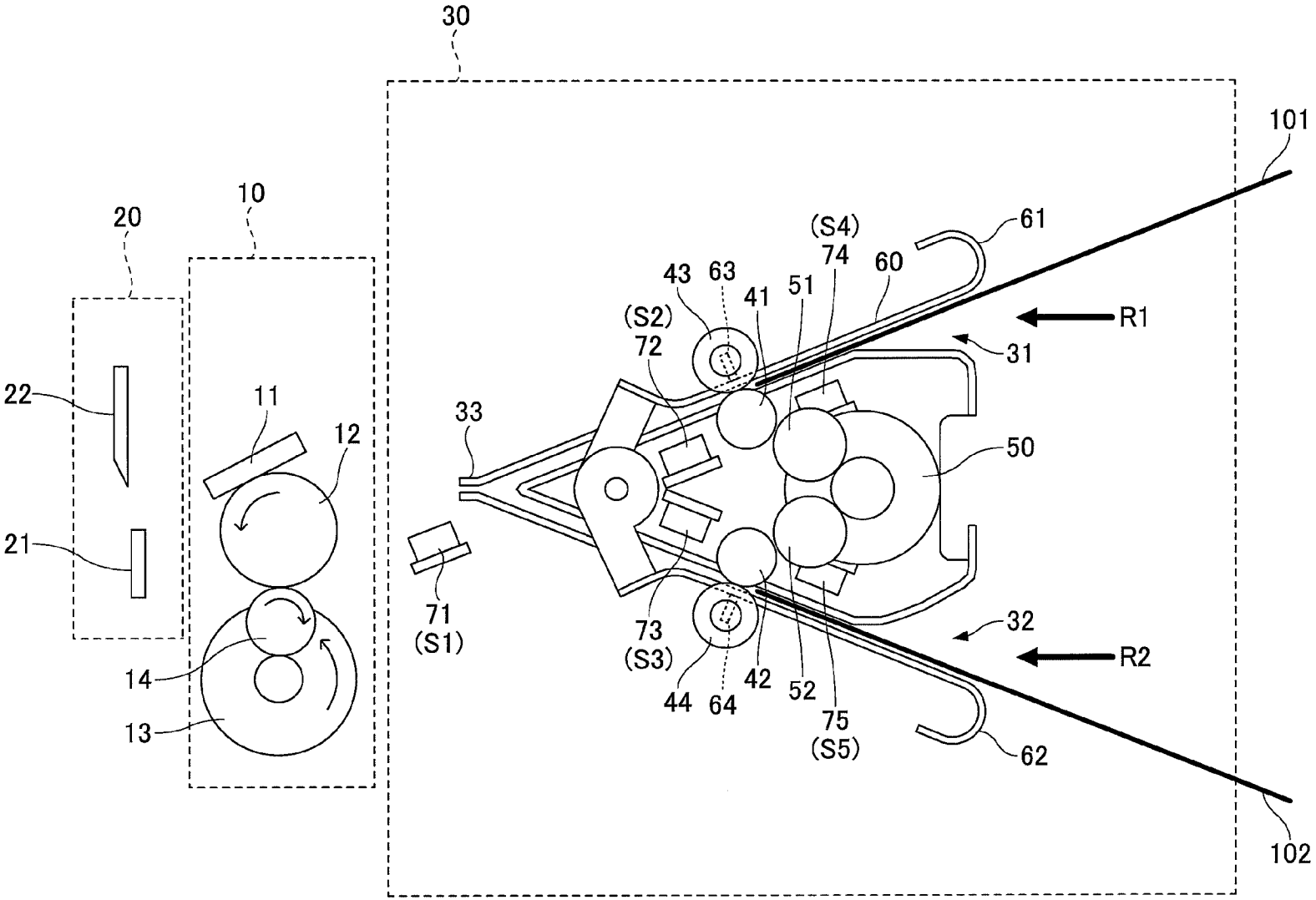
FIG. 1 illustrates a configuration of a printer apparatus according to a first embodiment of the present invention.

In the following, embodiments of the present invention are described with reference to the accompanying drawings. Note that the same or corresponding features shown in more than one of the drawings may be given the same reference numerals and their descriptions may be omitted.

First Embodiment

Printer Apparatus

A printer apparatus according to a first embodiment of the present invention is described below. As illustrated in FIG. 1, the printer apparatus according to the first embodiment includes a printing part 10, a cutter part 20, and a recording paper feeding part 30 that is capable of feeding two different sets of recording paper to the printing part 10. Note that recording paper is an example of a recording sheet.

The printing part 10 includes a thermal head 11, a platen roller 12, a printing part motor 13, and a gear 14. The thermal head 11 is a print head for printing objects on recording paper. The thermal head 11 is configured to print objects on recording paper that is held between the thermal head 11 and the platen roller 12. The printing part motor 13 is a motor for rotating the platen roller 12 via the gear 14. When the printing part motor 13 is rotated, recording paper may be conveyed toward the cutter part 20. Note that although not illustrated, the printing part motor 13 and the gear 14 may have gear teeth.

The cutter part 20 includes a stationary blade 21 and a movable blade 22. By moving the movable blade 22 toward the stationary blade 21, recording paper having objects printed by the printing part 10 may be cut.

The recording paper feeding part 30 includes a first roller 41, a second roller 42, a third roller 43, a fourth roller 44, a conveying motor 50, gears 51 and 52, a tension member 60, a first sensor (S1) 71, a second sensor (S2) 72, a third sensor (S3) 73, a fourth sensor (S4) 74, and a fifth sensor (S5) 75. Note that although not illustrated, the gears 51 and 52 may have gear teeth.

Two types of recording paper; namely, first recording paper 101 and second recording paper 102 may be fed to the recording paper feeding part 30. When feeding recording paper to the recording paper feeding part 30, the first recording paper 101 may be inserted into a first feed port 31 from a first feeding route R1, and the second recording paper 102 may be inserted into a second feed port 32 from a second feeding route R2.

The tension member 60 has spring properties and may be made of a metallic material having elasticity, for example. The tension member 60 includes an end part 61 arranged at the first feeding route R1 side where the first recording paper 101 is fed, and an end part 62 arranged at the second feeding route R2 side where the second recording paper 102 is fed. The end parts 61 and 62 are arranged into circular shapes. In the present embodiment, the material forming the tension member 60 has spring properties. That is, the tension member 60 is configured to exert a restoring force urging the end part 61 and the end part 62 toward each other.

The third roller 43 and the fourth roller 44 are rotatably connected to the tension member 60. A roller connection part 63 is arranged at the end part 61 side of the tension member 60, and the third roller 43 is rotatably connected to the roller connection part 63. A roller connection part 64 is arranged at the end part 62 side of the tension member 60, and the fourth roller 44 is rotatably connected to the roller connection part 64. The third roller 43 and the fourth roller 44 are thus arranged at the outer sides of the first roller 41 and the second roller 42, respectively. In this way, the third roller 43 may be pressed toward the first roller 41 and the fourth roller 44 may be pressed toward the second roller 42 by the restoring force of the tension member 60.

The conveying motor 50 is a motor for conveying the first recording paper 101 and the second recording paper 102 within the recording paper feeding part 30. The first recording paper 101 may be conveyed by rotating the first roller 41 via the gear 51, and the second recording paper 102 may be conveyed by rotating the second roller 42 via the gear 52.

The first recording paper 101 that is fed to the recording paper feeding part 30 is inserted from the first feeding route R1 into the end part 61 side of the tension member 60 forming the first feed port 31 and is held between the first roller 41 and the third roller 43. When the conveying motor 50 is rotated counterclockwise in such a state, the gear 51 rotates clockwise, the first roller 41 rotates counterclockwise, and the first recording paper 101 is conveyed toward the printing part 10 side within the recording paper feeding part 30. In this case, the third roller 43, which is connected to the first roller 41 via the first recording paper 101, rotates clockwise.

The second recording paper 102 that is fed to the recording paper feeding part 30 is inserted from the second feeding route R2 into the end part 62 side of the tension member 60 forming the second feed port 32 and is held between the second roller 42 and the fourth roller 44. When the conveying motor 50 is rotated clockwise in such a state, the gear 51 rotates counterclockwise, the second roller 42 rotates clockwise, and the second recording paper 102 is conveyed toward the printing part 10. In this case, the fourth roller 44 connected to the second roller 42 via the second recording paper 102 rotates counterclockwise.

To perform printing on the first recording paper 101 at the printing part 10, the conveying motor 50 is rotated counterclockwise so that the first recording paper 101 at the recording paper feeding part 30 may be conveyed further toward the printing part 10. In this way, the first recording paper 101 is conveyed to the printing part 10 via a delivery port 33 and held between the thermal head 11 and the platen roller 12 of the printing part 10, and in such a state, the printing part motor 13 is rotated counterclockwise. When the printing part motor 13 is rotated counterclockwise, the gear 14 rotates clockwise and the platen roller 12 rotates counterclockwise. In this way, the first recording paper 101 may be subject to printing by the thermal head 11 while being conveyed toward the cutter part 20. The first recording paper 101 conveyed to the cutter part 20 may then be cut at a desired length by the stationary blade 21 and the movable blade 22.

To perform printing on the second recording paper 102 at the printing part 10, the conveying motor 50 is rotated clockwise so that the second recording paper 102 at the recording paper feeding part 30 may be conveyed further toward the printing part 10. In this way, the second recording paper 102 is conveyed to the printing part 10 via the delivery port 33 and held between the thermal head 11 and the platen roller 12 of the printing part 10, and in such a state, the printing part motor 13 is rotated counterclockwise. When the printing part motor 13 is rotated counterclockwise, the gear 14 rotates clockwise and the platen roller 12 rotates counterclockwise. In this way, the second recording paper 102 may be subject to printing by the thermal head 11 while being conveyed toward the cutter part 20. The second recording paper 102 conveyed to the cutter part 20 may then be cut at a desired length by the stationary blade 21 and the movable blade 22.

(Modified Examples of Printer Apparatus)

In the following, modified examples of the printer apparatus are described.

Figure 2:
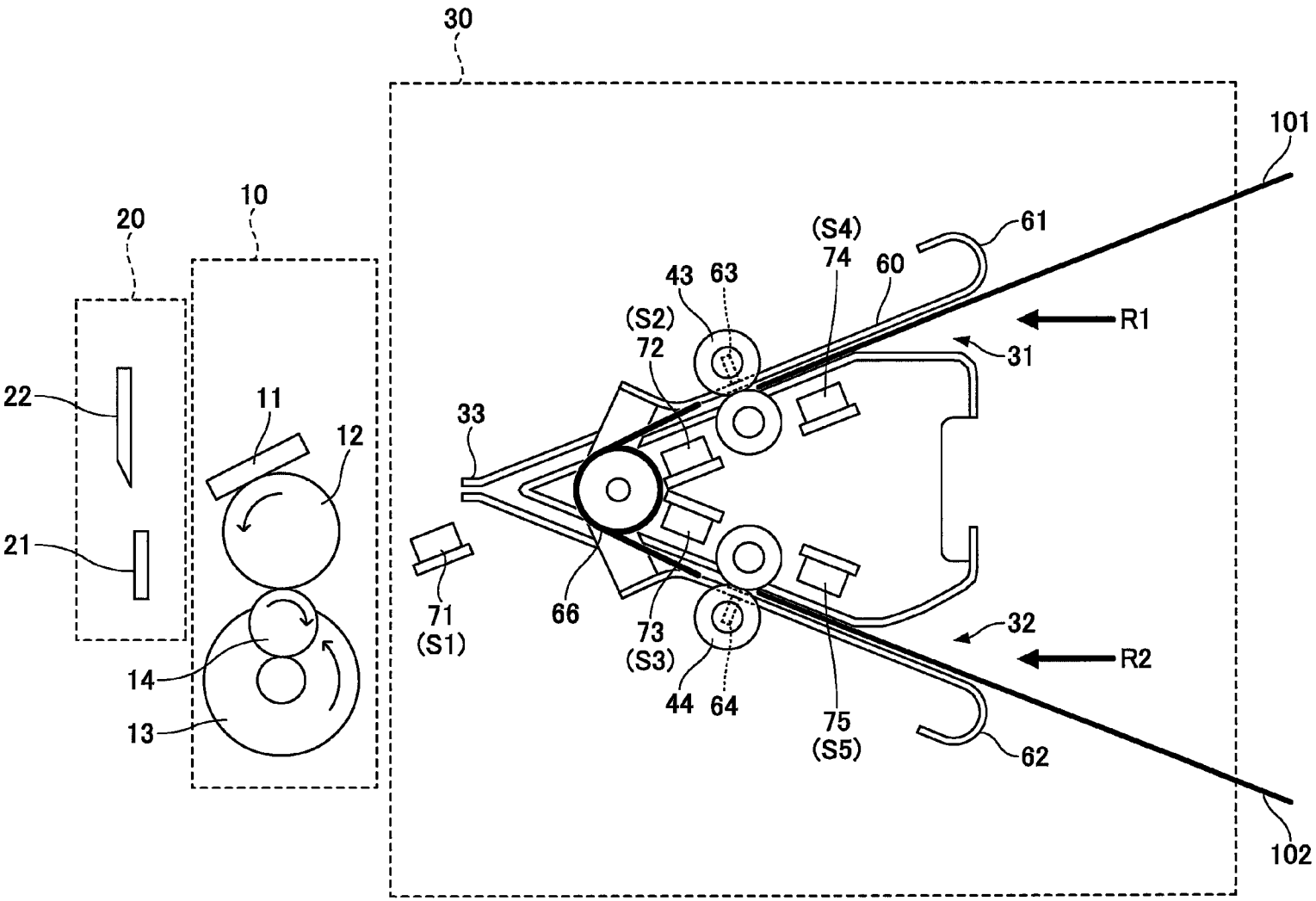
FIG. 2 illustrates a first modified example of the printer apparatus according to the first embodiment.

A metallic material forming a tension member 60 of a printer apparatus as illustrated in FIG. 2 does not have a restoring force as described above, but a torsion coil spring 66 is arranged at a center portion of the tension member 60. The torsion coil spring 66 may exert a restoring force urging the end part 61 and the end part 62 of the tension member 60 toward each other, for example.

Figure 3:
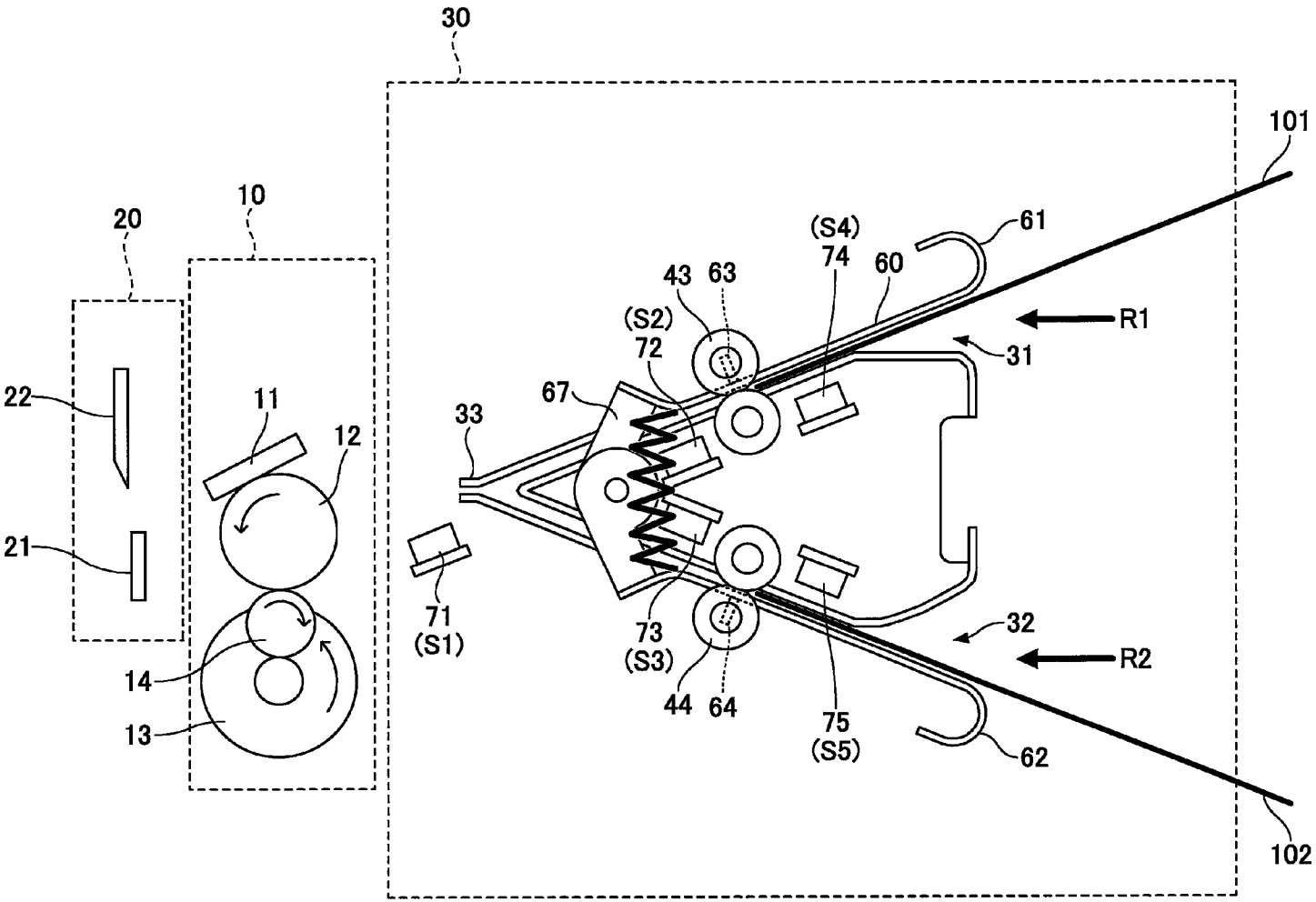
FIG. 3 illustrates a second modified example of the printer apparatus according to the first embodiment.

Alternatively, as illustrated in FIG. 3, a compression coil spring 67 may be arranged at the center portion of the tension member 60 of the printer apparatus. The compression coil spring 67 may exert a restoring force urging the end part 61 and the end part 62 of the tension member 60 toward each other, for example.

Figure 4:
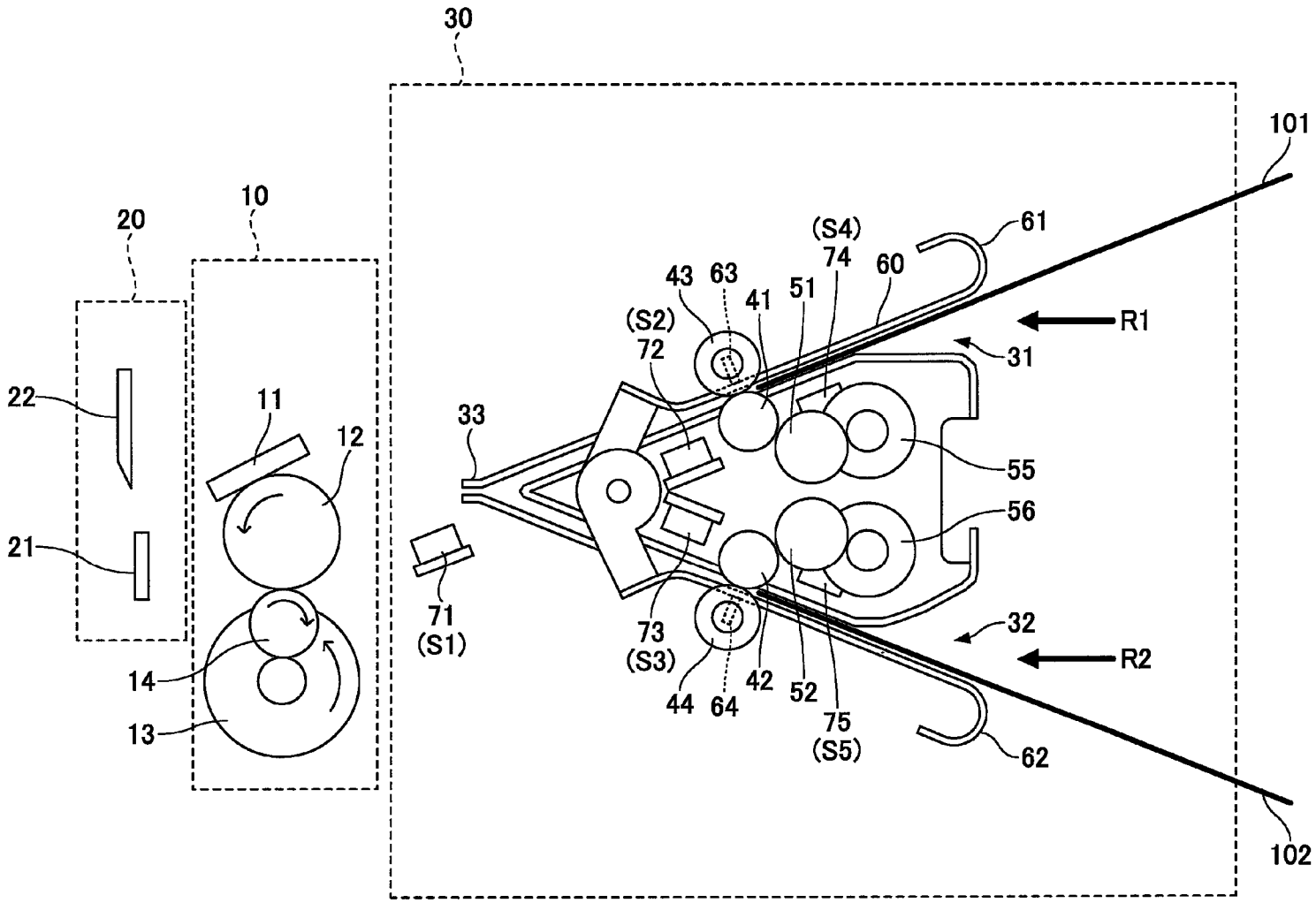
FIG. 4 illustrates a third modified example of the printer apparatus according to the first embodiment.

In another example, as illustrated in FIG. 4, two conveying motors may be provided at the printer apparatus. That is, a first conveying motor 55 and a second conveying motor 56 may be provided instead of the single conveying motor 50 illustrated in FIG. 1. The first conveying motor 55 is for conveying the first recording paper 101 that is inserted into the first feed port 31, and the second conveying motor 56 is for conveying the second recording paper 102 that is inserted into the second feed port 32.

By rotating the first conveying motor 55 counterclockwise, the first roller 41 may be rotated counterclockwise via the gear 51 and the first recording paper 101 may be conveyed toward the printing part 10. By rotating the second conveying motor 56 clockwise, the second roller 42 may be rotated clockwise via the gear 52 and the second recording paper 102 may be conveyed toward the printing part 10.

(Printer Apparatus Control Method)

In the following, a method for controlling the printer apparatus according to the first embodiment is described.

Figure 5:
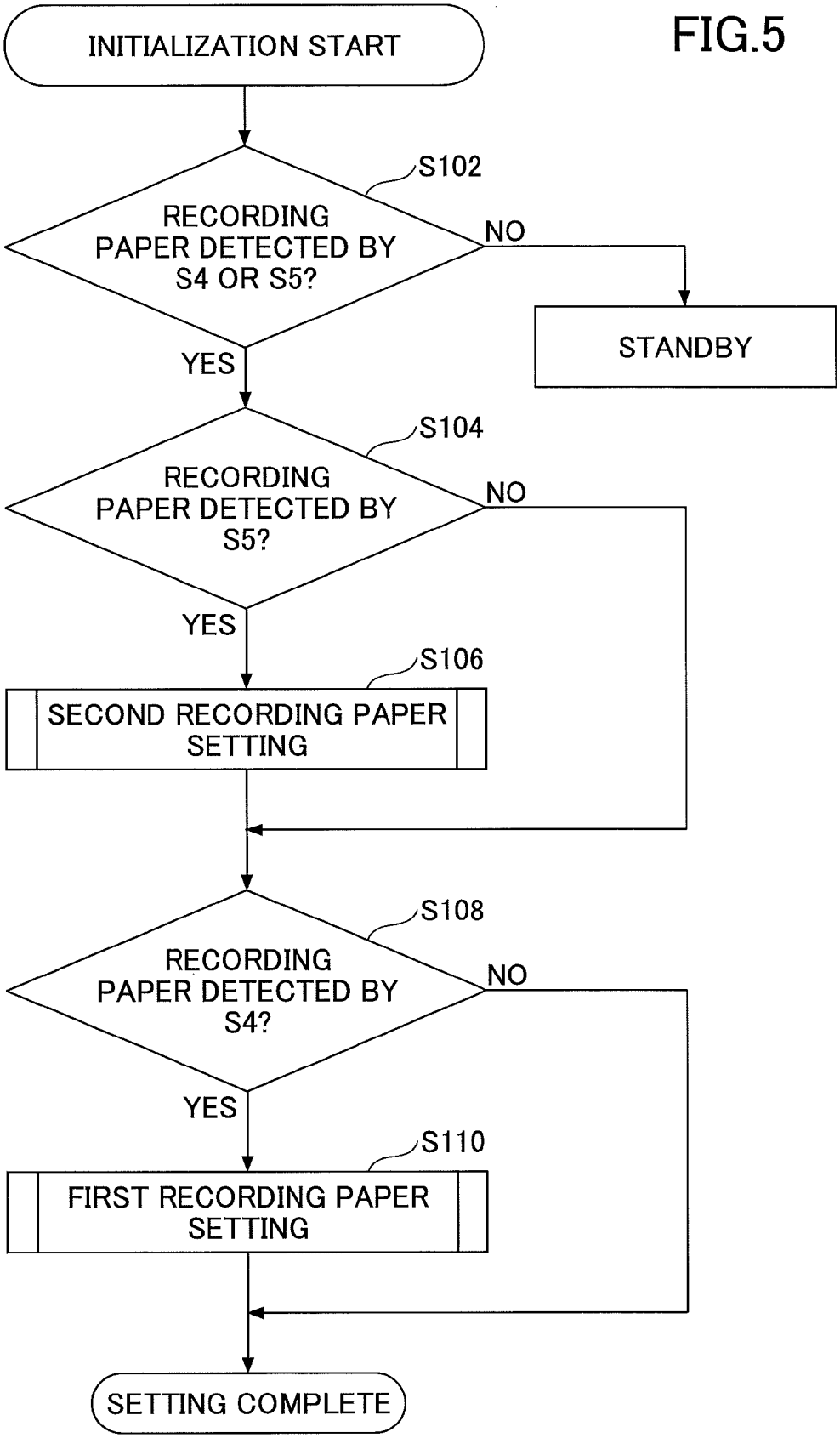
FIG. 5 is a flowchart illustrating exemplary process steps of a control method for controlling the printer apparatus according to the first embodiment.

Referring, to FIG. 5, an initialization operation; namely, recording paper setting operations of the printer apparatus are described below. In the flowcharts provided hereunder, the first sensor 71 through the fifth sensor 75 are described as "S1" through "S5".

In step S102, whether recording paper is detected by the fourth sensor 74 or the fifth sensor 75 is determined. If recording paper is detected by the fourth sensor 74 or the fifth sensor 75; namely, if the first recording paper 101 is detected by the fourth sensor 74 or the second recording paper 102 is detected by the fifth sensor 75, the operation proceeds to step S104. On the other hand, if recording paper is not detected by the fourth sensor 74 and the fifth sensor 75; namely, if the first recording paper 101 is not detected by the fourth sensor 74 and the second recording paper 102 is not detected by the fifth sensor 75, it is determined that the printer apparatus is in a standby state.

Next, in step S104, whether the second recording paper 102 is detected by the fifth sensor 75 is determined. If the second recording paper 102 is detected by the fifth sensor 75, the operation proceeds to step S106. On the other hand, if the second recording paper 102 is not detected by the fifth sensor 75, the operation proceeds to step S108.

Next, in step S106, a second recording paper setting operation is performed. The second recording paper setting operation is described in detail below.

Next, in step S108, whether the first recording paper 101 is detected by the fourth sensor 74 is determined. If the first recording paper 101 is detected by the fourth sensor 74, the operation proceeds to step S110. On the other hand, if the first recording paper 101 is not detected by the fourth sensor 74, the second recording paper setting operation is completed and the initialization operation is ended.

Next, in step S110, a first recording paper setting operation is performed. The first recording paper setting operation is described in detail below. After the first recording paper setting operation or the second recording paper setting operation is completed, the initialization operation is ended.

In the following, the second recording paper setting operation of step S106 in FIG. 5 is described with reference to FIG. 6.

In step S202, the conveying motor 50 is rotated clockwise. As a result, the second roller 42 rotates clockwise and the second recording paper 102 is conveyed toward the third sensor 73. Note that even if the first roller 41 also rotates clockwise, the first recording paper 101 is not conveyed in the case where the recording paper 101 is not held between the first roller 41 and the third roller 43.

Next, in step S204, whether the second recording paper 102 is detected by the third sensor 73 is determined. If the second recording paper 102 is detected by the third sensor 73, the operation proceeds to step S208. On the other hand, if the second recording paper 102 is not detected by the third sensor 73, the operation proceeds to step S206.

Next, in step S206, whether a predetermined time period has elapsed after the rotation of the conveying motor 50 is determined. If the predetermined time period has elapsed, it is determined that a jam error has occurred and an unjamming process is performed. On the other hand, if it is determined that the predetermined time period has not yet elapsed, steps S202 and S204 are repeated.

If the second recording paper is detected by the third sensor 73, in step S208, the conveying motor 50 is further rotated clockwise. As a result, the second roller 42 rotates clockwise and the second recording paper 102 is conveyed toward the first sensor 71.

Next, in step S210, whether the second recording paper 102 is detected by the first sensor 71 is determined. If the second recording paper 102 is detected by the first sensor 71, the operation proceeds to step S214. On the other hand, if the second recording paper 102 is not detected by the first sensor 71, the operation proceeds to step S212.

In step S212, whether a predetermined time period has elapsed after the conveying motor 50 has been rotated clockwise in step S208 is determined. If the predetermined time period has elapsed, it is determined that a jam error has occurred and an unjamming process is performed. On the other hand, if it is determined that the predetermined time period has not yet elapsed, steps S208 and S210 are repeated.

In step S214, the second recording paper 102 is conveyed for a predetermined distance. That is, the conveying motor 50 is further rotated clockwise to convey the second recording paper 102. Note that the conveying distance of the second recording paper 102 is arranged to be an adequately long distance such that the second recording paper 102 may still be held between the second roller 42 and the fourth roller 44 even when the first recording paper setting operation is performed as described below.

Figure 6:
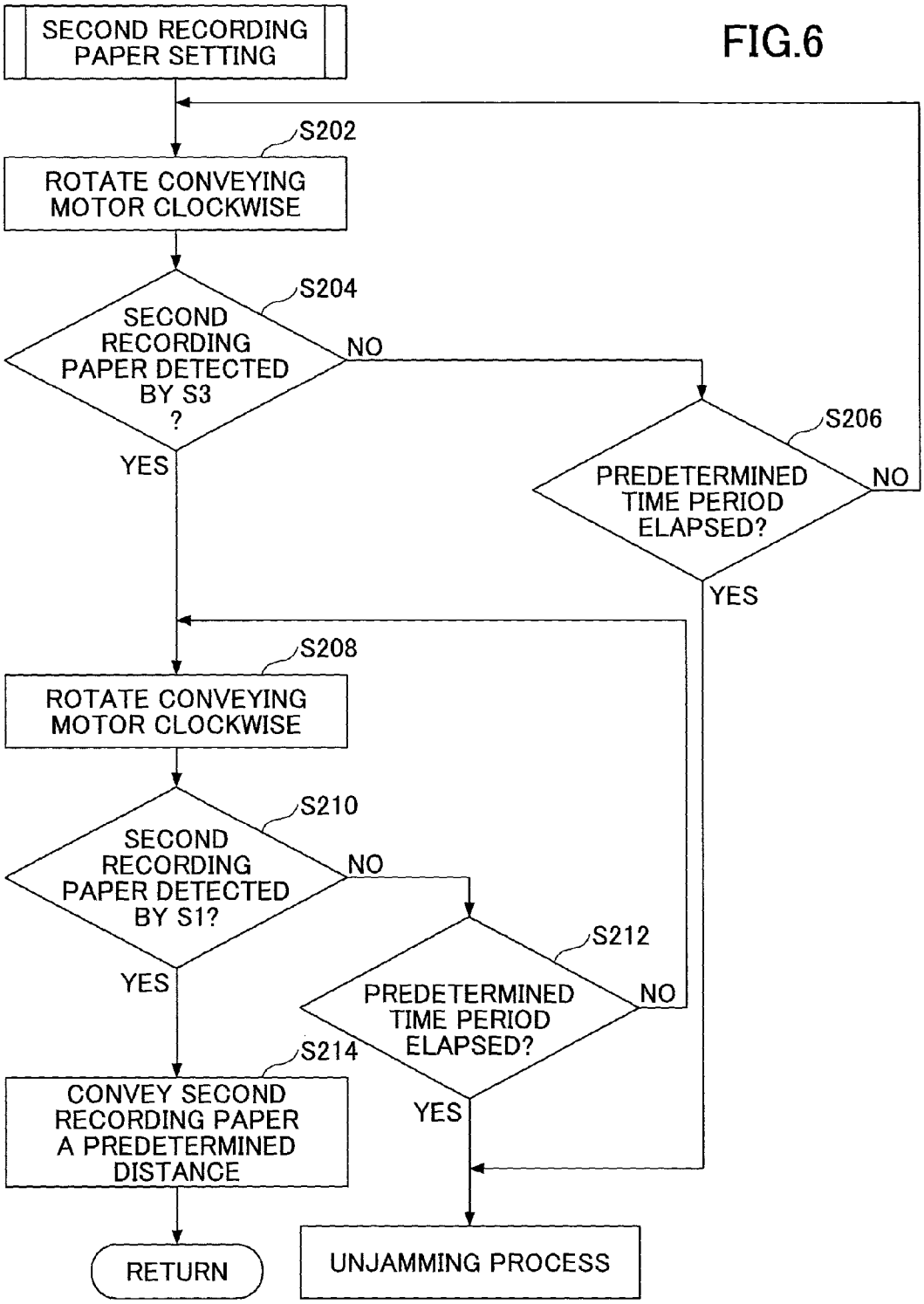
FIG. 6 is a flowchart illustrating a subroutine of the control method for controlling the printer apparatus according to the first embodiment.

By performing the above process steps, the process illustrated in FIG. 6; namely, the second recording paper setting operation of step S106 in FIG. 5, is completed.

In the following, the first recording paper setting operation of step S110 in FIG. 5 is described with reference to FIG. 7.

In step S302, the conveying motor 50 is rotated counterclockwise. As a result, the first roller 41 rotates counterclockwise and the first recording paper 101 is conveyed toward the second sensor 72. Note that the second roller 42 also rotates counterclockwise in this case, and the second recording paper 102 that is held between the second roller 42 and the fourth roller 44 is conveyed backward in an opposite direction away from the printing part 10.

Next, in step S304, whether the first recording paper 101 is detected by the second sensor 72 is determined. If the first recording paper 101 is detected by the second sensor 72, the operation proceeds to step S308. On the other hand, if the first recording paper 101 is not detected by the second sensor 72, the operation proceeds to step S306.

In step S306, whether a predetermined time period has elapsed after the conveying motor 50 has been rotated counterclockwise is determined. If the predetermined time period has elapsed, it is determined that a jam error has occurred and an unjamming process is performed. On the other hand, if it is determined that the predetermined time period has not yet elapsed, steps S302 and S304 are repeated.

If the first recording paper is detected by the second sensor 72, in step S308, the conveying motor 50 is further rotated counterclockwise. As a result, the first recording paper 101 is conveyed toward the first sensor 71. Note that in this step, the second recording paper 102 is moved backward by the second roller 42 so that the second recording paper 102 would not be detected by the first sensor 71. The conveying distance of the second recording paper 102 in step S212 of FIG. 6 is set up such that the second recording paper 102 would not be detected by the first sensor 71.

Next, in step S310, whether the first recording paper 101 is detected by the first sensor 71 is determined. If the first recording paper 101 is detected by the first sensor 71, the operation proceeds to step S314. On the other hand, if the first recording paper 101 is not detected by the first sensor 71, the operation proceeds to step S312.

In step S312, whether a predetermined time period has elapsed after the conveying motor 50 has been rotated counterclockwise in step S308 is determined. If the predetermined time period has elapsed, it is determined that a jam error has occurred and an unjamming process is performed. On the other hand, if it is determined that the predetermined time period has not yet elapsed, steps S308 and S310 are repeated.

In step S314, the first recording paper 101 is conveyed for a predetermined distance. That is, the conveying motor 50 is further rotated counterclockwise to convey the first recording paper 101 to a contact point between the thermal head 11 and the platen roller 12. Note that the second recording paper 102 is held between the second roller 42 and the fourth roller 44 in this case.

Figure 7:
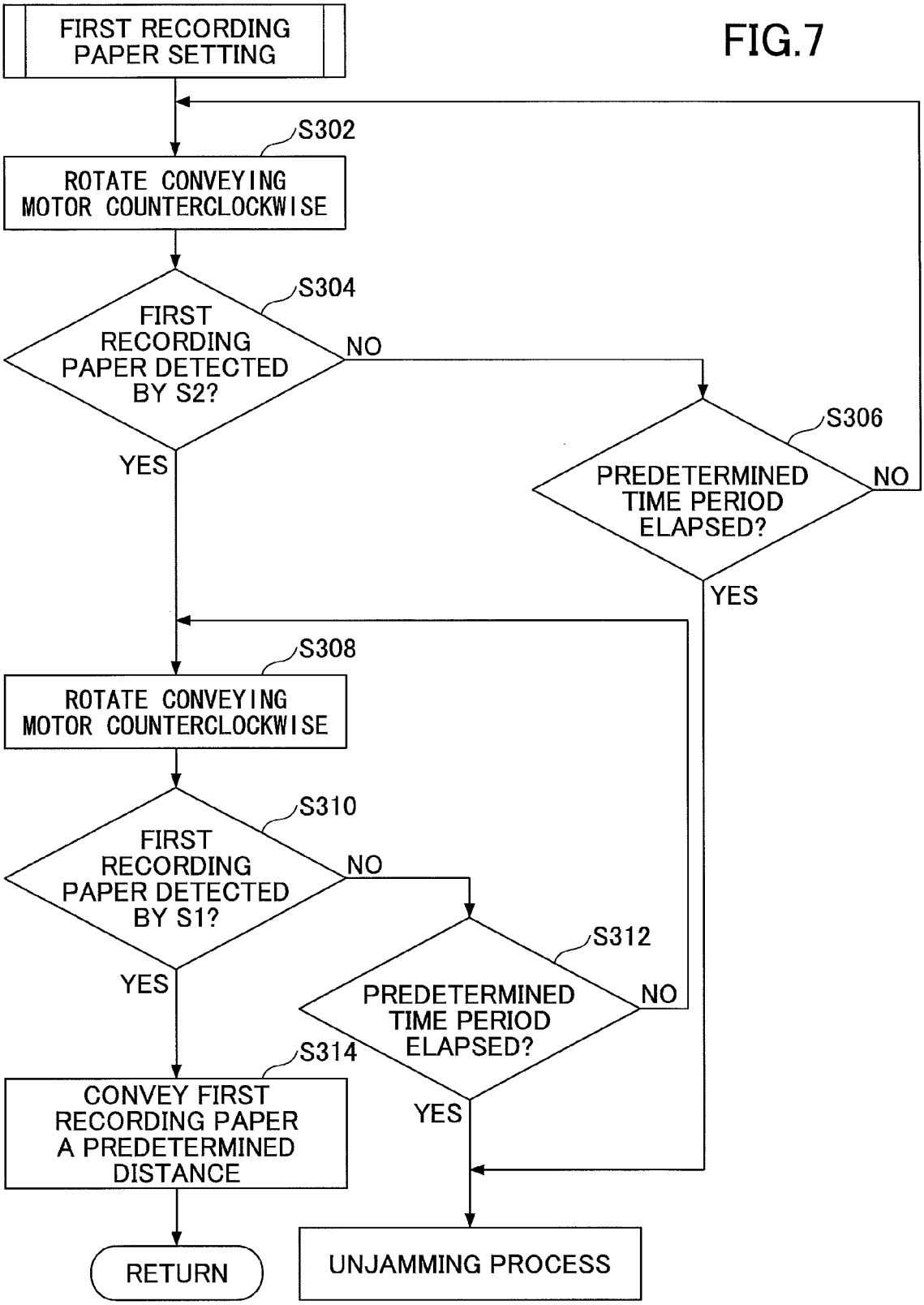
FIG. 7 is a flowchart illustrating another subroutine of the control method for controlling the printer apparatus according to the first embodiment.

By performing the above process steps, the process illustrated in FIG. 7; namely, the first recording paper setting operation of step S110 in FIG. 5, is completed.

In the following, a printing operation on the recording paper; namely, the first recording paper 101 or that second recording paper, performed after completing the initialization operation of FIG. 5 is described.

Figure 8:
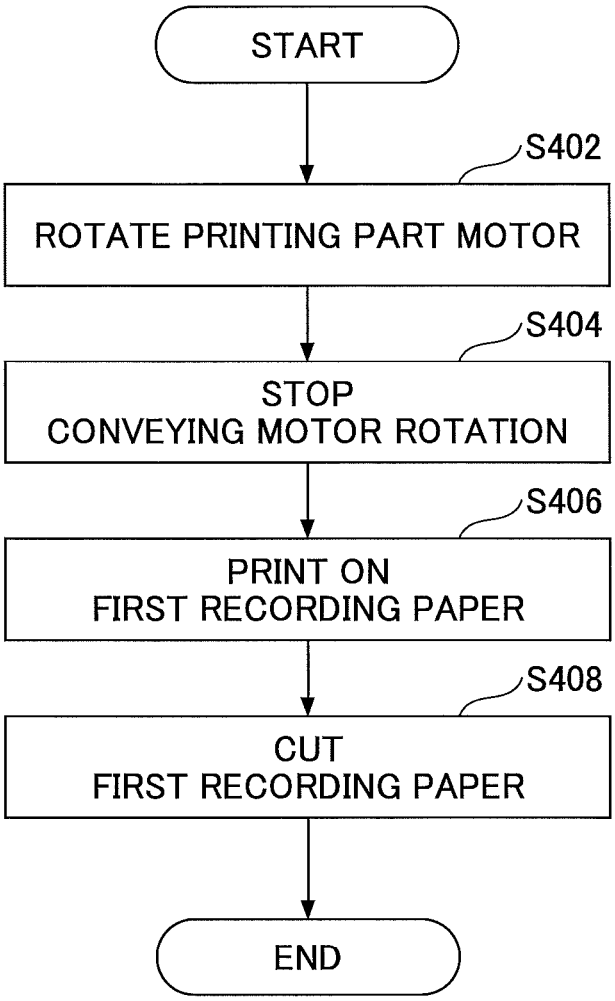
FIG. 8 is a flowchart illustrating further process steps of the control method for controlling the printer apparatus according to the first embodiment.

FIG. 8 illustrates a printing operation on the first recording paper 101.

In step S402, the printing part motor 13 is rotated counterclockwise. As a result, the platen roller 12 rotates counterclockwise via the gear 14 and the first recording paper 101 is inserted between the thermal head 11 and the platen roller 12. Hereinafter, the first recording paper 101 is conveyed by rotating the printing part motor 13 counterclockwise.

Next, in step S404, rotation of the conveying motor 50 is stopped because the first recording paper 101 can be conveyed by the counterclockwise rotation of the printing part motor 13 even without the counterclockwise rotation of the conveying motor 50. Note that at this point, even if the second recording paper 102 is interposed between the second roller 42 and the fourth roller 44, by stopping the rotation of the conveying motor 50, the second recording paper 102 may not be moved any further in the backward direction.

Next, in step S406, printing is performed on the first recording paper 101 while the first recording paper 101 is conveyed by rotating the printing part motor 13 counterclockwise.

Next, in step S408, after the printing on the first recording paper 101 is completed, the first recording paper 101 is cut at the cutter part 20. In turn, the printing operation of FIG. 8 is ended.

By performing the above process, the printing operation on the first recording paper 101 is completed.

Figure 9:
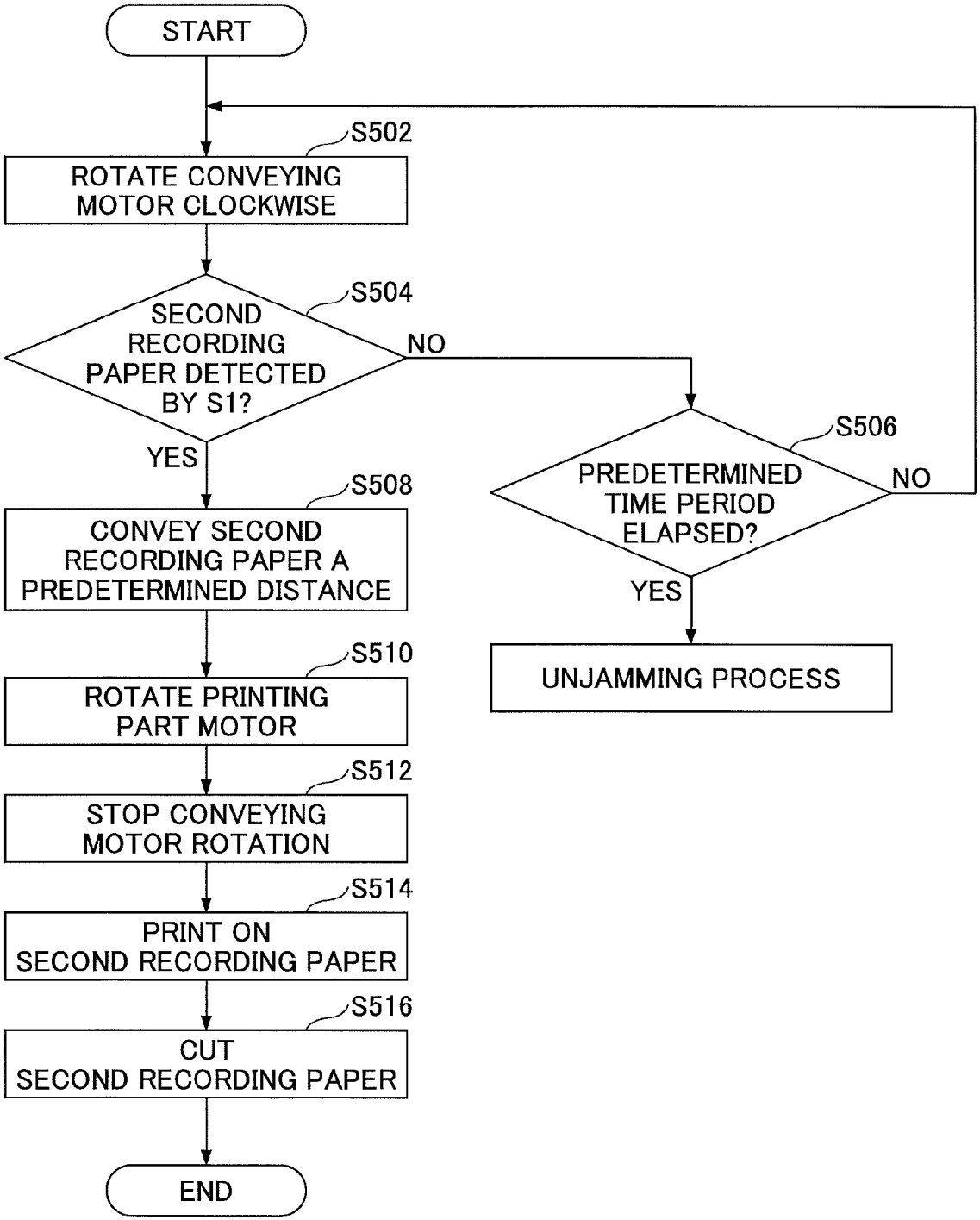
FIG. 9 is a flowchart illustrating further process steps of the control method for controlling the printer apparatus according to the first embodiment.

In the following, a printing operation on the second recording paper 102 performed after the initialization process of FIG. 5 is described with reference to FIG. 9.

In step S502, the conveying motor 50 is rotated clockwise. As a result, the second recording paper 102 is conveyed toward the first sensor 71.

Next, in step S504, whether the second recording paper 102 is detected by the first sensor 71 is determined. If the second recording paper 102 is detected by the first sensor 71, the operation proceeds to step S508. On the other hand, if the second recording paper 102 is not detected by the first sensor 71, the operation proceeds to step S506.

In step S506, whether a predetermined time period has elapsed after rotation of the conveying motor 50 in step S502 is determined. If the predetermined time period has elapsed, it is determined that a jam error has occurred and an unjamming process is performed. On the other hand, if it is determined that the predetermined time period has not yet elapsed, steps S502 and S504 are repeated.

In step S508, the second recording paper 102 is conveyed for a predetermined distance. That is, the conveying motor 50 is further rotated clockwise to convey the second recording paper 102 to a contact point between the thermal head 11 and the platen roller 12. Note that at this point, the first recording paper 101 may be interposed between the first roller 41 and the third roller 43.

Next, in step S510, the printing part motor 13 is rotated counterclockwise. As a result, the platen roller 12 is rotated counterclockwise via the gear 14 and the second recording paper 102 is inserted between the thermal head 11 and the platen roller 12. Hereinafter, the second recording paper 102 is conveyed by rotating the printing part motor 13 counterclockwise.

Next, in step S512, the rotation of the conveying motor 50 is stopped because the second recording paper 102 can be conveyed by the counterclockwise rotation of the printing part motor 13 without rotating the conveying motor 50. Note that at this point, the first recording paper 101 interposed between the first roller 41 and the third roller 43 may not be moved any further because the rotation of the conveying motor 50 is stopped.

Next, in step S514, printing is performed on the second recording paper 102 while the second recording paper 102 is conveyed.

Next, in step S516, after the printing on the second recording paper 102 is completed, the second recording paper 102 is cut at the cutter part 20. In turn, the printing operation of FIG. 9 is ended.

By performing the above process, the printing operation on the second recording paper 102 is completed. Note that when performing a printing operation on the second recording paper 102 in a case where the first recording paper setting operation is not performed in the initialization operation of FIG. 5; namely, in the case where step S110 of FIG. 5 is not performed, steps S502 through S508 of FIG. 9 may be omitted and only steps S510 through S516 of the above operation are performed.

In the following, recording paper switching and printing operations are described with reference to FIG. 10. That is, exemplary operations for switching from the first recording paper 101 to the second recording paper 102 after the printing operation on the first recording paper 101 of FIG. 8 has been completed, and performing a printing operation on the second recording paper 102 are described below.

Figure 11:
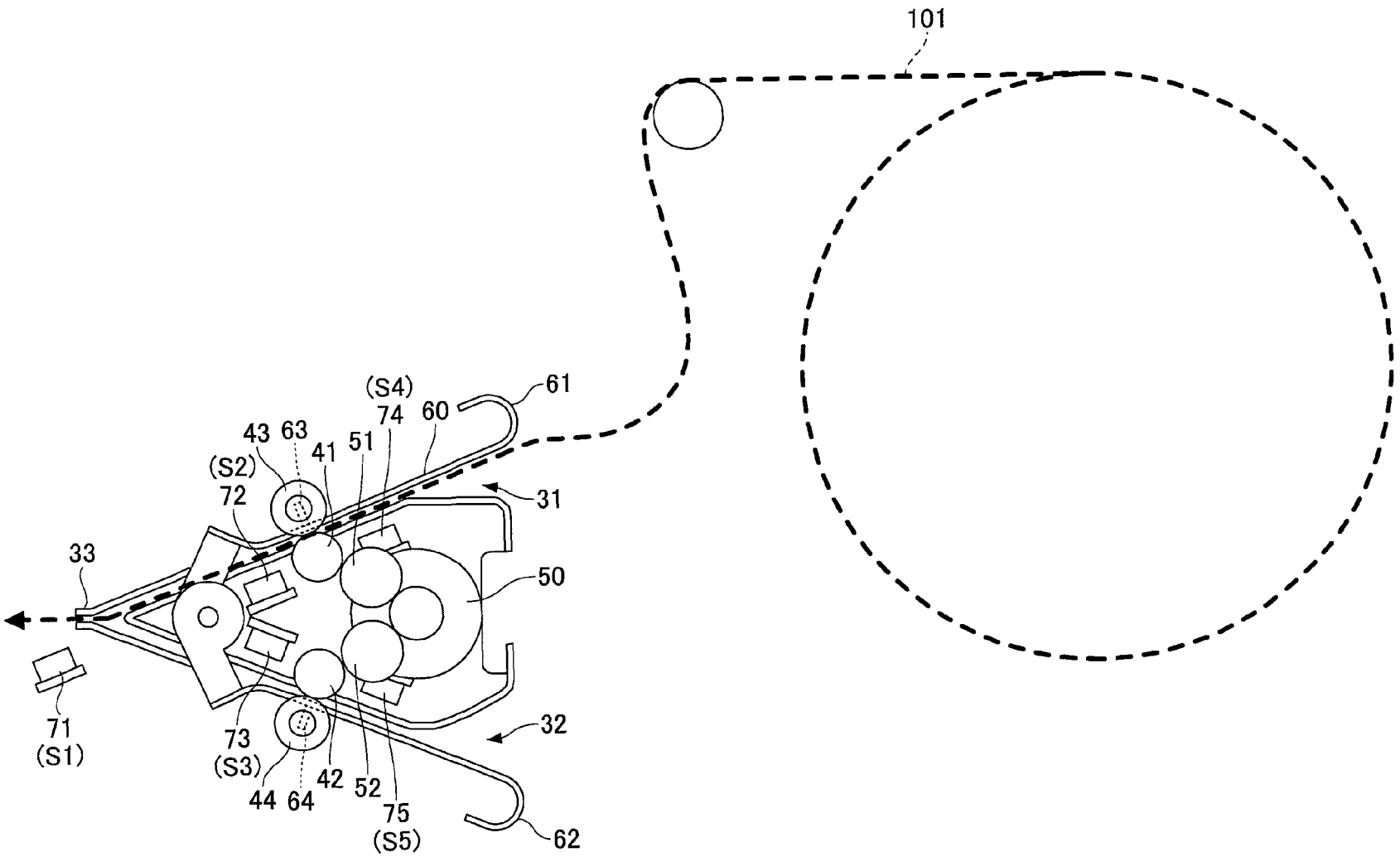
FIG. 11 illustrates an operation state of the printer apparatus according to the first embodiment.
Figure 12:
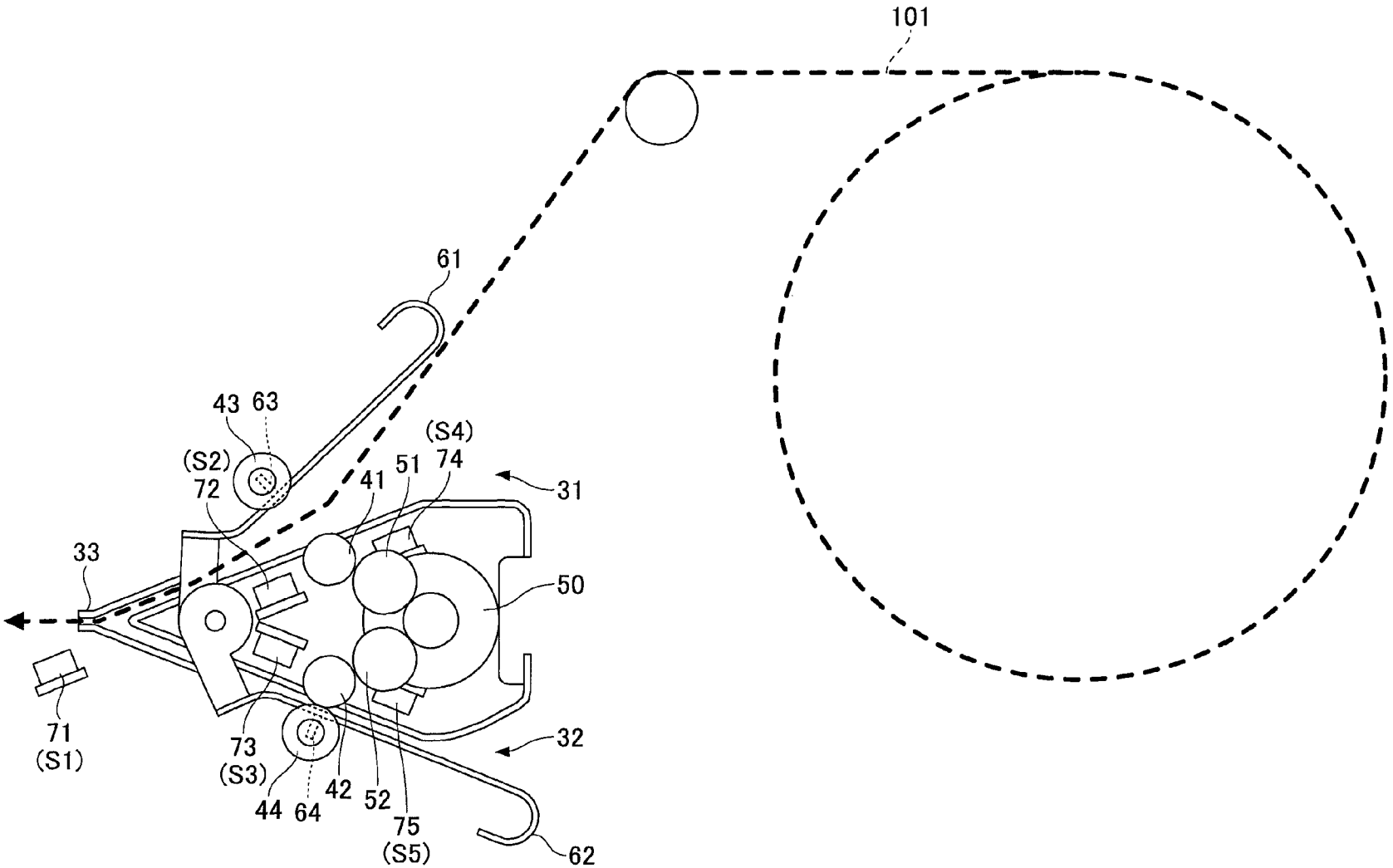
FIG. 12 illustrates another operation state of the printer apparatus according to the first embodiment.

Rolled paper may be used as the first recording paper 101 and the second recording paper 102. FIG. 11 illustrates a state where the first recording paper 101 is conveyed by the first roller 41 and the third roller 43. When a printing operation is performed on the first recording paper 101, the printer apparatus transition from a state as illustrated in FIG. 11 to a state as illustrated in FIG. 12. As illustrated in FIG. 12, the end part 61 of the tension member 60 is raised by the first recording paper 101 conveyed by the platen roller 12, and the distance between the end part 61 and the end part 62 of the tension member 60 is widened. Therefore, the third roller 43 that has been in contact with the first roller 41 via the first recording paper 101 moves away from the first roller 41, and the first recording paper 101 ceases to be in contact with the first roller 41. When the first roller 41 and the third roller 43 move away from one another as illustrated in FIG. 12, the first recording paper 101 is conveyed by the printing part motor 13, and the first roller 41 ceases to have a contributory effect on conveying the first recording paper 101.

Similar transitions apply in the case of printing on the second recording paper 102. That is, when a printing operation is performed on the second recording paper 102, the end part 62 of the tension member 60 is raised by the second recording paper 102 conveyed by the platen roller 12, and the distance between the end part 61 and end part 62 of the tension member 60 is widened. Therefore, the fourth roller 44 that has been in contact with the second roller 42 via the second recording paper 102 moves away from the second roller 42, and the second recording paper 102 ceases to be in contact with the second roller 42.

Figure 10:
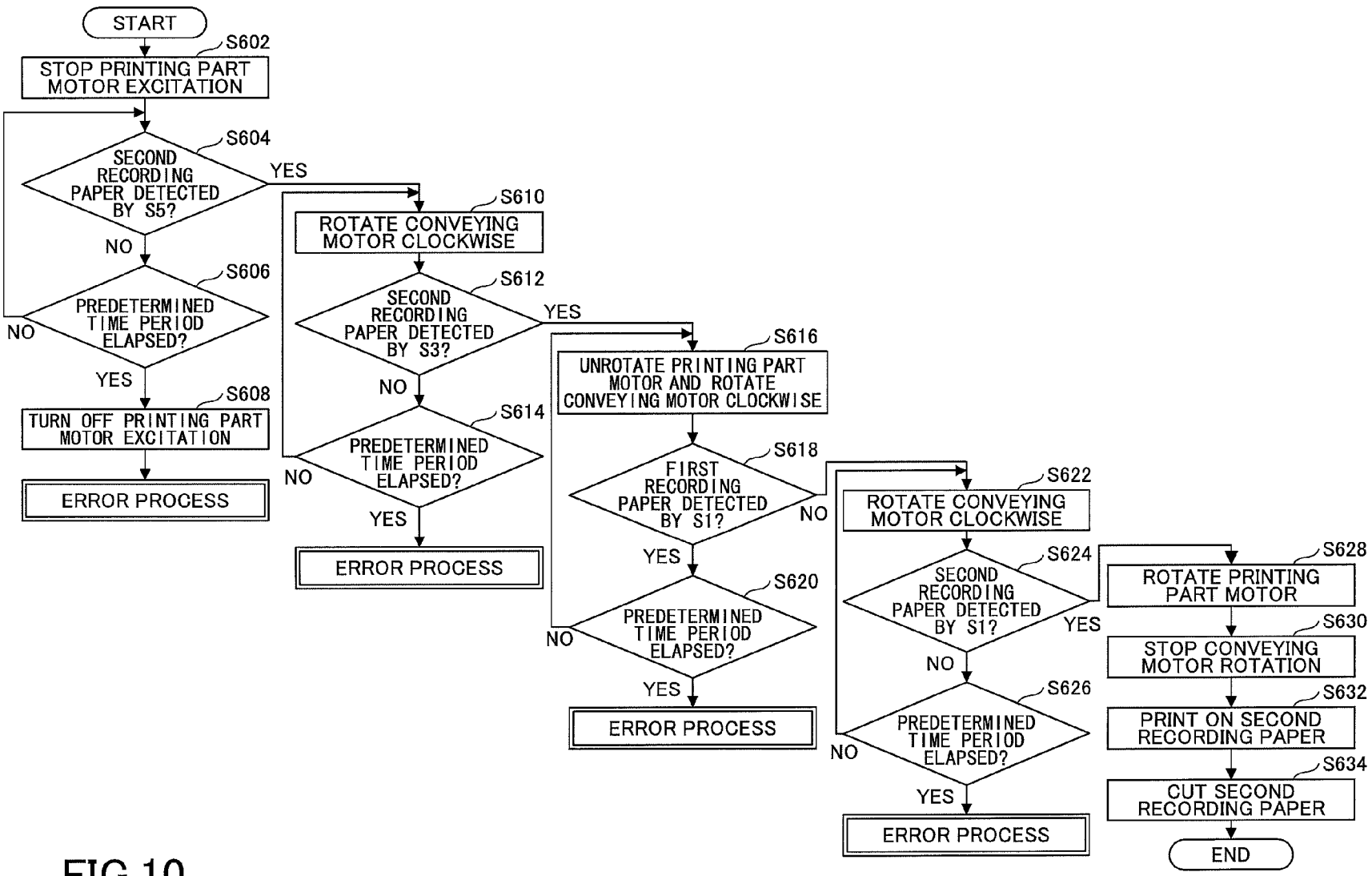
FIG. 10 is a flowchart illustrating further process steps of the control method for controlling the printer apparatus according to the first embodiment.

The operations illustrated in FIG. 10 utilize the above-described features of the printer apparatus of the present embodiment.

First, while in the state as illustrated in FIG. 12, in step S602, excitation of the printing part motor 13 is stopped. In this way, the rotation of the printing part motor 13 is stopped and the first recording paper 101 remains held between the thermal head 11 and the platen roller 12.

Next, in step S604, whether the second recording paper 102 is detected by the fifth sensor 75 is determined. If the second recording paper 102 is detected by the fifth sensor 75, the operation proceeds to step S610. On the other hand, if the second recording paper 102 is not detected by the fifth sensor 75, the operation proceeds to step S606.

In step S606, whether a predetermined time period has elapsed after the excitation of the printing part motor 13 has been stopped is determined. If it is determined that the predetermined time period has elapsed, the operation proceeds to step S608. If it is determined that the predetermined time period has not yet elapsed, step S604 is repeated.

In step S608, the conveying part motor 13 is turned off, and an error process is performed thereafter.

In step S610, the conveying motor 50 is rotated clockwise. As a result, the second roller 42 rotates clockwise and the second recording paper 102 is conveyed toward the third sensor 73. Note that although the first roller 41 rotates clockwise in this case, because the third roller 43 is raised by the first recording paper 101 as illustrated in FIG. 12, the first roller 41 and the third roller 43 are set apart from each other, and the first roller 41 is not in contact with the first recording paper 101. Therefore, the first roller 41 may be prevented from applying a force to the first recording paper 101 even when the first roller 41 is rotated.

Next, in step S612, whether the second recording paper 102 is detected by the third sensor 73 is determined. If the second recording paper 102 is detected by the third sensor 73, the operation proceeds to step S616. On the other hand, if the second recording paper 102 is not detected by the third sensor 73, the operation proceeds to step S614.

In step S614, whether a predetermined time period has elapsed after the conveying motor 50 has been rotated clockwise in step S610 is determined. If the predetermined time period has elapsed, it is determined that an error has occurred and an error process is performed. On the other hand, if it is determined that the predetermined time period has not yet elapsed, steps S610 and S612 are repeated.

In step S616, the printing part motor 13 is rotated clockwise (in FIG. 10, rotating the printing part motor 13 clockwise is referred to as "unrotate printing part motor") and the conveying motor 50 is further rotated clockwise. As a result, the first recording paper 101 is moved away from the thermal head 11 and the platen roller 12 and is released from the thermal head 11 and the platen roller 12. That is, the first recording paper 101 is moved backward in a direction opposite the direction toward the cutter part 20. Meanwhile, the second recording paper 102 is conveyed toward the first sensor 71.

In step S618, whether the first recording paper 101 is detected by the first sensor 71 is determined. If the first recording paper 101 is detected by the first sensor 71, the operation proceeds to step S620. On the other hand, if the first recording paper 101 is not detected by the first sensor 71, this means that the first recording paper 101 has been moved back to a position such that it would not be detected by the first sensor 71, and the operation proceeds to step S622.

In step S620, a determination is made as to whether a predetermined time period has elapsed after the conveying motor 50 has been rotated clockwise in step S616 is determined. If the predetermined time period has elapsed, it is determined that an error has occurred and an error process is performed. On the other hand, if it is determined that the predetermined time period has not yet elapsed, steps S616 and S618 are repeated.

In step S622, the conveying motor 50 is further rotated clockwise. As a result, the second recording paper 102 is conveyed toward the first sensor 71.

Next, in step S624, whether the second recording paper is detected by the first sensor 71 is determined. If the second recording paper is detected by the first sensor 71, the operation proceeds to step S628. On the other hand, if the second recording paper is not detected by the first sensor 71, the operation proceeds to step S626.

In step S626, whether a predetermined time period has elapsed after the conveying motor 50 has been rotated clockwise in step S622 is determined. If the predetermined time period has elapsed, it is determined that an error has occurred and an error process is performed. On the other hand, if it is determined that the predetermined time period has not yet elapsed, steps S622 and S624 are repeated.

If the second recording paper 102 is detected by the first sensor 71, in step S628, the conveying motor 50 is further rotated clockwise while the printing part motor 13 is rotated counterclockwise. As a result, the platen roller 12 is rotated counterclockwise via the gear 14, and the second recording paper 102 is inserted between the thermal head 11 and the platen roller 12. Hereinafter, the second recording paper 102 is conveyed by rotating the printing part motor 13 counterclockwise.

Next, in step S630, rotation of the conveying motor 50 is stopped because the second recording paper 102 may be conveyed by the counterclockwise rotation of the printing part motor 13 without the clockwise rotation of the conveying motor 50. At this point, the first recording paper 101 is interposed between the first roller 41 and the third roller 43, and by stopping the rotation of the conveying motor 50, the first recording paper 101 may not be moved further.

Figure 13:
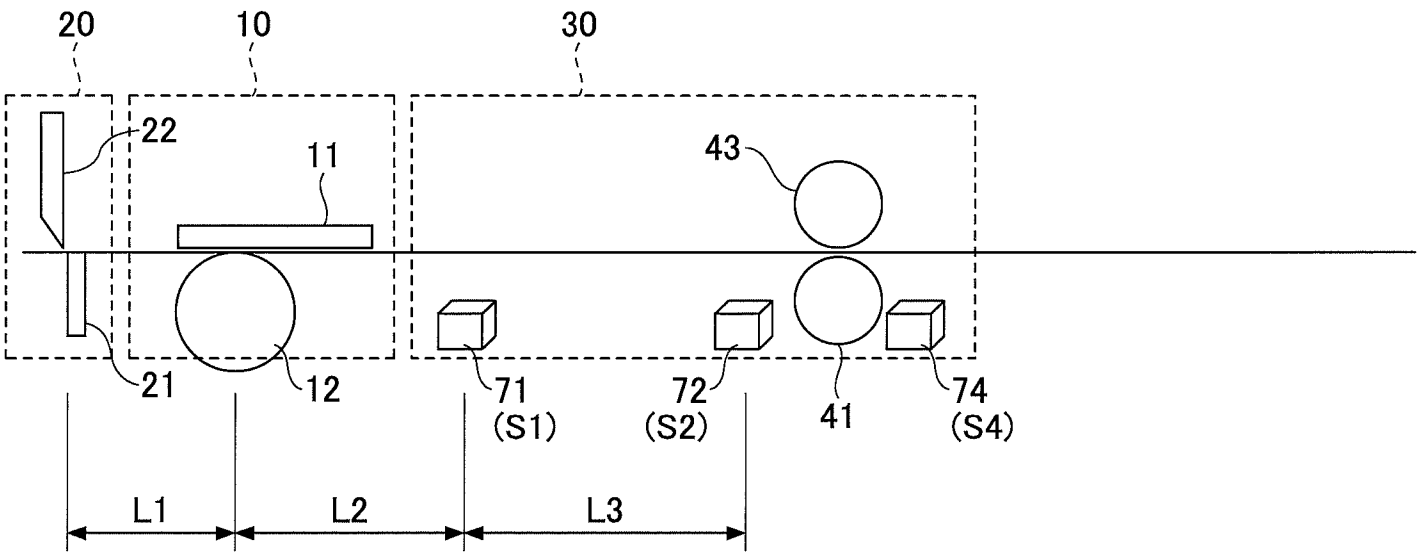
FIG. 13 illustrates a preferred arrangement of components of the printer apparatus according to the first embodiment.

In an embodiment, as illustrated in FIG. 13, the cutter part 20, the thermal head 11, the platen roller 12, the first sensor 71, and the second sensor 72 are arranged such that a length L1 between the cutter part 20 and the terminal head 11/platen roller 12, a length L2 between the terminal head 11/platen roller 12 and the first sensor (S1) 71, and a length L3 between the first sensor (S1) 71 and the second sensor (S2) 72 satisfy the following relationship: (L1+L2)<L3. Note that in the case where the first recording paper 101 is not detected by the second sensor (S2) 72, the conveying motor 50 may be rotated counterclockwise and the first recording paper 101 may be conveyed to a position at which it would not be detected by the second sensor (S2) 72.

Next, in step S632, printing is performed on the second recording paper 102 by the thermal head 11 while the second recording paper 102 is conveyed by further rotating the printing part motor 13.

Next, in step S634, after the printing on the second recording paper 102 has been completed, the second recording paper 102 is cut at the cutter part 20. In this way, the operations for switching from the first recording paper 101 to the second recording paper 102 and printing on the second recording paper 102 is ended.

Note that a method for controlling a printer apparatus according to an embodiment of the present invention has been described above. However, the present invention encompasses other numerous variations and modifications of the above control method.

Second Embodiment

In the following, a second embodiment of the present invention is described. A printer apparatus according to the second embodiment includes a plurality of the recording paper feeding parts 30 described above, and a first feed port 31 or a second feed port 32 of one recording paper feeding part 30 is connected to a delivery port 33 of another recording paper feeding part 30.

Figure 14:
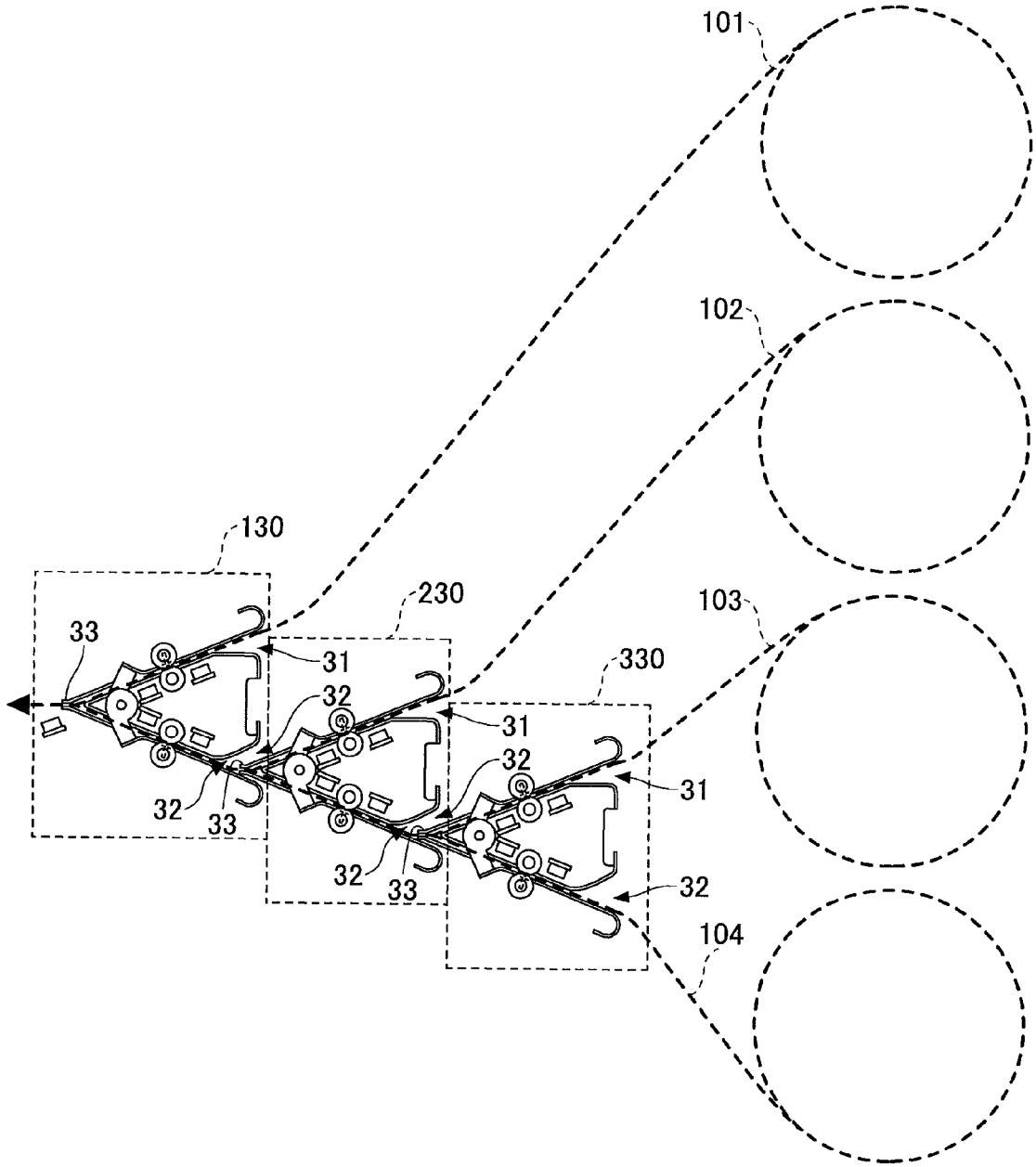
FIG. 14 illustrates a configuration of a printer apparatus according to a second embodiment of the present invention.

For example, as illustrated in FIG. 14, the printer apparatus according to the present embodiment may include a first recording paper feeding part 130, a second recording paper feeding part 230, and a third recording paper feeding part 330, which have substantially the same configuration as the recording paper feeding part 30 described above and are cascade-connected. That is, a printing part 10 (not shown in FIG. 14) is connected to a delivery port 33 of the first recording paper feeding part 130, a second feed port 32 of the first recording paper feeding part 130 is connected to a delivery port 33 of the second recording paper feeding part 230, and a second feed port 32 of the second recording paper feeding part 230 is connected to a delivery port 33 of the third recording paper feeding part 330.

First recording paper 101 is inserted into a first feed port 31 of the first recording paper feeding part 130, second recording paper 102 is inserted into a first feed port 31 of the second recording paper feeding part 230, third recording paper 103 is inserted into a first feed port 31 of the third recording paper feeding part 330, and fourth recording paper 104 is inserted into the second feed port 32 of the third recording paper feeding part 330.

According to an aspect of the present embodiment, the printing part 10 may perform a printing operation on four different types of recording paper; namely, the first recording paper 101, the second recording paper 102, the third recording paper 103, and the fourth recording paper 104. Note that the number of types of recording paper on which printing may be performed by the printing part 10 may be further increased by increasing the number of recording paper feeding parts 30 provided in the printer apparatus.

For example, a recording paper feeding part having a configuration similar to that of the recording paper feeding part 30 may be connected to the first feed port 31 of the first recording paper feeding part 130, and two more recording paper feeding parts having configurations similar to that of the recording paper feeding part 30 may be connected to the first feed port 31 and the second feed port 32 of the recording paper feeding part connected to the first recording paper feeding part 130. Further, a recording paper feeding part having a configuration similar to that of the recording paper feeding part 30 may be connected to the first feed port 31 of the second recording paper feeding part 230. In this way, printing may be performed on eight different sets of recording paper, for example. Note that the number of different sets of recording paper on which printing may be performed by the printing part 10 may be increased further by increasing the number of recording paper feeding parts that are cascade-connected.

Although the present invention is described above with respect to certain illustrative embodiments, the present invention is not limited to these embodiments but encompasses numerous variations and modifications that may be made without departing from the spirit and scope of the present invention.

What is claimed is:

1. A printer apparatus comprising:

a printing part that includes a platen roller and a print head for printing objects onto a recording sheet; and a feeding part configured to feed the recording sheet to the printing part, the feeding part including a first feed port for feeding a first recording sheet;

a second feed port for feeding a second recording sheet;

a first roller for conveying the first recording sheet fed through the first feed port;

a second roller for conveying the second recording sheet fed through the second feed port;

a delivery port for feeding the first recording sheet conveyed by the first roller and the second recording sheet conveyed by the second roller;

a tension member having elasticity, the tension member includes a first end part provided at a position close to the first feed port, and a second end part provided at a position close to the second feed port;

a third roller rotatably connected to the tension member and being pressed toward the first roller by the elasticity of the tension member; and a fourth roller rotatably connected to the tension member and being pressed toward the second roller by the elasticity of the tension member, wherein the tension member is configured to exert a restoring force in a direction urging the third roller and the fourth roller toward each other and urging the two end parts toward each other, and the first and second end parts are configured to be opened at the upstream side of the feeding part.

2. The printer apparatus as claimed in claim 1, wherein when switching the recording paper subject to printing at the printing part from the first recording sheet to the second recording sheet, a force is applied to the third roller by the first recording sheet in a direction urging the third roller away from the first roller, and the second recording sheet is conveyed toward the printing part by the second roller and the fourth roller while the first roller and the third roller are set apart from each other.

3. The printer apparatus as claimed in claim 1, wherein the tension member includes a spring; and the spring exerts a restoring force in a direction urging the third roller and the fourth roller toward each other.

4. The printer apparatus as claimed in claim 1, wherein the first roller and the second roller are rotated by one conveying motor.

5. The printer apparatus as claimed in claim 1, wherein a plurality of the feeding parts are arranged such that a feed port of one of the feeding parts is connected to a delivery port of another feeding part.

6. The printer apparatus as claimed in claim 1, wherein the third roller is provided at a position closer to the delivery port relative to the first end part, and the fourth roller is provided at a position closer to the delivery port relative to the second end part.

7. A control method for controlling a printer apparatus including a printing part that includes a print head and a platen roller driven by a printing part motor, and a feeding part for feeding a recording sheet to the printing part, the feeding part including a plurality of feed ports for feeding different recording sheets, a first roller for conveying a first recording sheet fed through a first feed port, a second roller for conveying a second recording sheet fed through a second feed port, a tension member having elasticity, the tension member includes a first end part provided at a position close to the first feed port and a second end part provided at a position close to the second feed port, a third roller rotatably connected to the tension member, and a fourth roller rotatably connected to the tension member, the control method comprising:

when switching the recording sheet subject to printing at the printing part from the first recording sheet to the second recording sheet, stopping rotation of the printing part motor while the first recording sheet is held between the print head and the platen roller, rotating the second roller and conveying the second recording sheet toward the printing part while the first recording sheet is held between the print head and the platen roller, and rotating the printing part motor and releasing the first recording sheet from the print head and the platen roller when the second recording sheet is conveyed to a predetermined position, wherein when the rotation of the printing part motor is stopped while the first recording sheet is held between the print head and the platen roller, a force is applied to the third roller by the first recording sheet in a direction urging the third roller away from the first roller, and the first roller and the third roller are set apart from each other, and wherein the first and second end parts are opened at an upstream side of the feeding part by the force of the first recording sheet being applied to one of the first and second end parts.

8. The control method for controlling the printer apparatus as claimed in claim 7, wherein when printing is performed on the first recording sheet, a force is applied to the third roller by the first recording sheet in a direction urging the third roller away from the first roller, and the first roller and the third roller are set apart from each other.

* * * * *